US011181019B2

(12) United States Patent
Ikebe et al.

(10) Patent No.: US 11,181,019 B2
(45) **Date of Patent: *Nov. 23, 2021**

(54) INTERNAL COMBUSTION ENGINE

(71) Applicant: HONDA MOTOR CO., LTD., Tokyo (JP)

(72) Inventors: Yoshiyuki Ikebe, Wako (JP); Makoto Harada, Wako (JP); Fumihiko Matsubara, Wako (JP); Toshiaki Deguchi, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/494,124

(22) PCT Filed: Feb. 8, 2018

(86) PCT No.: PCT/JP2018/004395

§ 371 (c)(1),
(2) Date: Sep. 13, 2019

(87) PCT Pub. No.: WO2018/179889

PCT Pub. Date: Oct. 4, 2018

(65) Prior Publication Data

US 2020/0040780 A1 Feb. 6, 2020

(30) Foreign Application Priority Data

Mar. 28, 2017 (JP) ..... JP2017-063118

(51) Int. Cl.

| | |
|---|---|
| ***F01M 11/03*** | (2006.01) |
| ***F01M 5/00*** | (2006.01) |
| ***F02B 67/00*** | (2006.01) |
| ***F02D 29/06*** | (2006.01) |
| ***F02F 7/00*** | (2006.01) |
| ***F02N 11/00*** | (2006.01) |

(52) U.S. Cl.
CPC ..... *F01M 11/03* (2013.01); *F01M 5/00* (2013.01); *F02B 67/00* (2013.01); *F02D 29/06* (2013.01); *F02F 7/00* (2013.01); *F02N 11/00* (2013.01)

(58) Field of Classification Search
CPC ..... F02D 41/009; F01L 1/022; F02B 75/22; F02F 7/0012
See application file for complete search history.

(56) References Cited

U.S. PATENT DOCUMENTS 5,634,422 A * 6/1997 Kobayashi ..... B63B 34/10 114/55.5
2001/0039908 A1* 11/2001 Bilek ..... F02B 33/44 114/55.5

(Continued)

FOREIGN PATENT DOCUMENTS

CN 1247939 A 3/2000
CN 101042090 A 9/2007

(Continued)

OTHER PUBLICATIONS

International Search Report, issued in PCT/JP2018/004395, dated Apr. 24, 2018.

*Primary Examiner* — Kevin A Lathers
(74) *Attorney, Agent, or Firm* — Birch, Stewart, Kolasch & Birch, LLP

(57) ABSTRACT

An internal combustion engine includes a crankshaft that is rotatably supported on the crankcase, a cylinder block that is joined to the crankcase and defines a plurality of cylinders in a V-type arrangement in which the cylinders are disposed above a virtual horizontal plane including a rotational axis of the crankshaft and intersect each other at a bank angle, a to-be-detected body that rotates integrally with the crankshaft, and a detection sensor that is mounted from an outside at a position, lower than the virtual horizontal plane, of a (Continued)

front face of the crankcase that receives air flow, is made to face a trajectory of the to-be-detected body, and generates a pulse signal in response to movement of the to-be-detected body. Thereby provided is a structure for disposing a detection sensor that can detect the angular velocity of a crankshaft with high precision in a so-called V-type internal combustion engine.

12 Claims, 5 Drawing Sheets

(56) References Cited

U.S. PATENT DOCUMENTS

| | | | | |
|---|---|---|---|---|
| 2002/0011222 | A1* | 1/2002 | Bilek | F01L 1/053 123/52.1 |
| 2002/0045391 | A1* | 4/2002 | Kanno | F02D 17/04 440/88 F |
| 2020/0049102 | A1* | 2/2020 | Iwasaki | G01M 15/06 |
| 2020/0132005 | A1* | 4/2020 | Ikebe | F02F 7/00 |

FOREIGN PATENT DOCUMENTS

| | | | |
|---|---|---|---|
| CN | 101713332 | A | 5/2010 |
| EP | 0987416 | A2 | 3/2000 |
| JP | 2510184 | Y2 | 9/1996 |
| JP | 2000-110517 | A | 4/2000 |
| JP | 2005-30311 | A | 2/2005 |
| JP | 2009-228560 | A | 10/2009 |
| JP | 2010-216416 | A | 9/2010 |
| JP | 2010-234949 | A | 10/2010 |
| JP | 2014-148920 | A | 8/2014 |
| JP | 2014-199040 | A | 10/2014 |
| WO | WO 2010/113677 | A1 | 10/2010 |

* cited by examiner

INTERNAL COMBUSTION ENGINE

TECHNICAL FIELD

The present invention relates to an internal combustion engine that includes a crankshaft that is rotatably supported on a crankcase, and a cylinder block that is joined to the crankcase and defines a plurality of cylinders in a V-type arrangement in which the cylinders are disposed above a virtual horizontal plane including a rotational axis of the crankshaft and intersect each other at a bank angle.

BACKGROUND ART

Patent Document 1 discloses a pulse sensor. The pulse sensor is made to face an outer rotor of a generator. The outer rotor is fixed to an extremity of a crankshaft. A to-be-detected body is mounted on an outer face of the outer rotor. The pulse sensor detects the to-be-detected body in response to rotation of the outer rotor and generates a pulse signal while synchronizing it with the rotation in response to the to-be-detected body being detected.

Patent Document 2 discloses a ring gear (to-be-detected body) that is mounted on a crankshaft of an internal combustion engine when determining misfiring. An extremity of an eddy current type microdisplacement sensor (detection sensor) opposes an outer peripheral face of the ring gear. The microdisplacement sensor detects the crank angle. The positional relationship between a crank chamber of the internal combustion engine and the microdisplacement sensor is not disclosed.

RELATED ART DOCUMENTS

Patent Documents

Patent Document 1: Japanese Utility Model Registration Publication No. 2510184

Patent Document 2: Japanese Patent Application Laid-open No. 2014-199040

SUMMARY OF THE INVENTION

Problems to be Solved by the Invention

It is desired that when determining misfiring the angular velocity of a crankshaft is detected with high precision. However, when the outer rotor of the generator plays the role of a ring gear, since the generator is disposed at a shaft end of the crankshaft, the run-out of the crankshaft increases, and it is difficult to detect the angular velocity of the crankshaft with high precision.

The present invention has been accomplished in light of the above circumstances, and it is an object thereof to provide, in a so-called V-type internal combustion engine, a structure for disposing a detection sensor that can detect the angular velocity of a crankshaft with high precision.

Means for Solving the Problems

According to a first aspect of the present invention, there is provided an internal combustion engine comprising a crankcase that defines a crank chamber, a crankshaft that is rotatably supported on the crankcase, a cylinder block that is joined to the crankcase and defines a plurality of cylinders in a V-type arrangement in which the cylinders are disposed above a virtual horizontal plane including a rotational axis of the crankshaft and intersect each other at a bank angle, a to-be-detected body that rotates integrally with the crankshaft, and a detection sensor that is mounted from an outside at a position, lower than the virtual horizontal plane, of a front face of the crankcase that receives air flow, is made to face a trajectory of the to-be-detected body, and generates a pulse signal in response to movement of the to-be-detected body.

According to a second aspect of the present invention, in addition to the first aspect, the internal combustion engine further comprises an oil cooler that is mounted on an outer face of the crankcase beneath the detection sensor.

According to a third aspect of the present invention, in addition to the first or second aspect, the internal combustion engine further comprises an exhaust pipe that is positioned further forward than the front face of the crankcase and at least partially overlaps the detection sensor when viewed from the front.

According to a fourth aspect of the present invention, in addition to any one of the first to third aspects, the detection sensor is disposed in one space resulting from partitioning by a virtual plane that is orthogonal to the rotational axis of the crankshaft at a middle position in an axial direction of the crankshaft, and a starter motor is disposed in another space resulting from the partitioning.

According to a fifth aspect of the present invention, in addition to any one of the first to fourth aspects, the internal combustion engine further comprises an oil filter mounted on the outer face of the crankcase at a position beneath the detection sensor.

According to a sixth aspect of the present invention, in addition to any one of the first to fifth aspects, the detection sensor is disposed in one space resulting from partitioning by a virtual plane that is orthogonal to the rotational axis of the crankshaft at the middle position in the axial direction of the crankshaft, and an AC generator is disposed in another space.

According to a seventh aspect of the present invention, in addition to any one of the first to sixth aspects, the detection sensor comprises a main body that is inserted into a through hole formed in the crankcase and faces the crank chamber via a detection part at an extremity, a connector that is joined to the main body and is disposed in a space outside the crankcase, and a fastening piece that is joined to the main body and is fastened to an outer face of the crankcase.

Effects of the Invention

In accordance with the first aspect, due to the detection sensor being mounted on the crankcase, the to-be-detected body can be separated from the outer rotor of a generator, and it is therefore possible to avoid the influence of an electromagnetic force acting between the outer rotor and an inner stator. The angular velocity of the crankshaft can be detected with high precision. Moreover, the detection sensor can be protected beneath the cylinder block. The detection sensor receives air flow and can thus be cooled. In addition, since the detection sensor is mounted from the outside of the crankcase, any increase in the dimensions of the crankcase or a case cover can be avoided.

In accordance with the second aspect, the oil cooler can protect the detection sensor from stones, etc. scattered up from the road.

In accordance with the third aspect, the exhaust pipe can protect the detection sensor from stones, etc. coming from the front.

In accordance with the fourth aspect, since the detection sensor is distant from the starter motor, the influence of the magnetic force of the starter motor can be avoided.

In accordance with the fifth aspect, the oil filter can protect the detection sensor from stones, etc. scattered up from the road.

In accordance with the sixth aspect, since the detection sensor is distant from the AC generator, the influence of the magnetic force of the AC generator can be avoided.

In accordance with the seventh aspect, the detection sensor is merely inserted into the through hole of the crankcase, the detection sensor can easily be fitted into the internal combustion engine, and since it is fastened to the outer face of the crankcase by means of the fastening piece, the sensor can be reliably fixed to the case outer face.

EXPLANATION OF REFERENCE NUMERALS AND SYMBOLS

Figure 1:
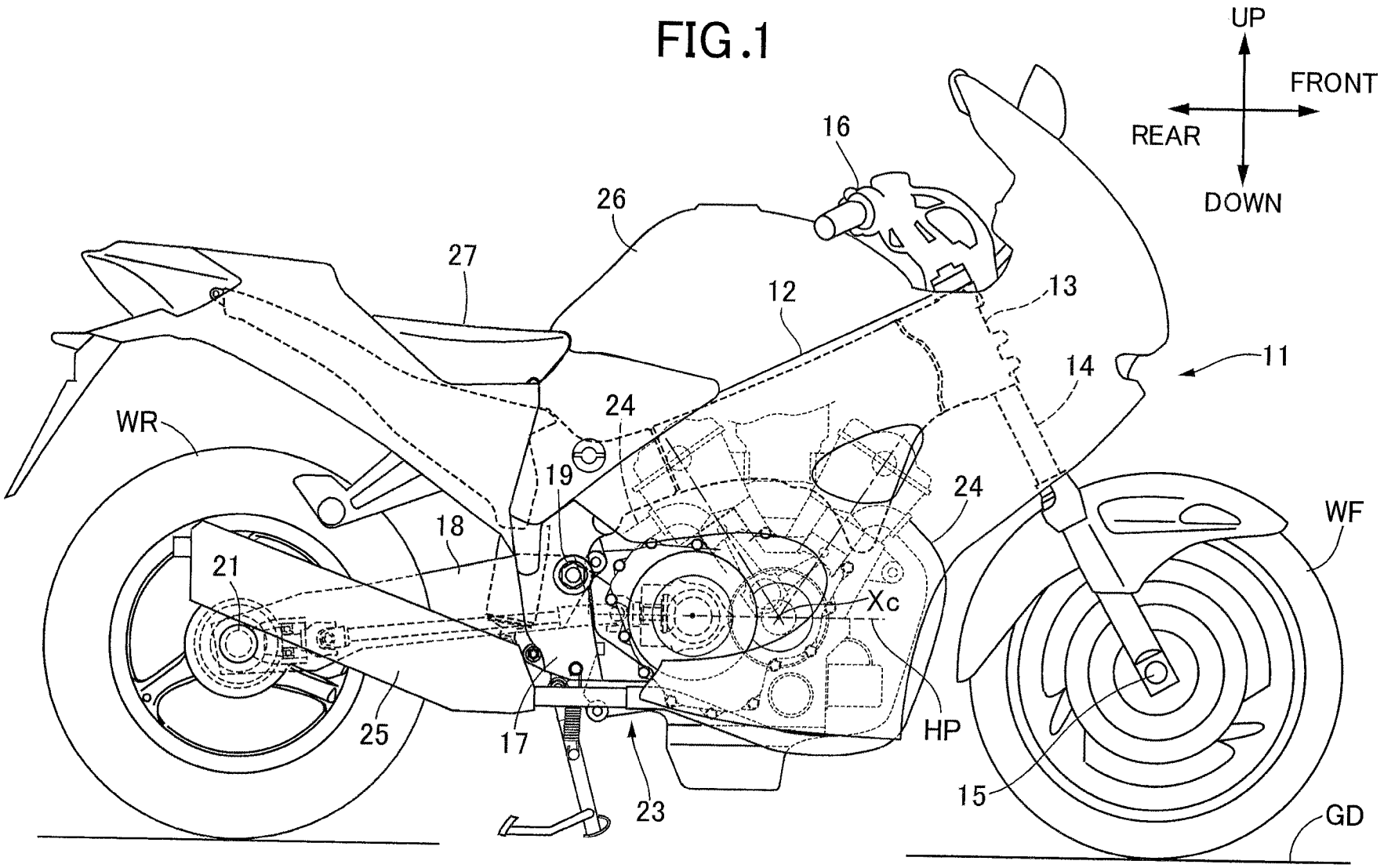
FIG. 1 is a side view schematically showing the overall arrangement of a two-wheeled motor vehicle. (first embodiment)

23 Internal combustion engine
24 Exhaust pipe
31 Crankcase
31*a* Front face of crankcase
32 Crankshaft
33 Cylinder block
36 Detection sensor (pulser sensor)
37 Oil cooler
39 Oil filter
41 Starter motor
43 Virtual plane
44*a* One space resulting from partitioning by virtual plane
44*b* Another space resulting from partitioning by virtual plane
45 AC generator
52 Crank chamber
55 Crank
61 To-be-detected body (pulser ring)
63 Through hole
64 Main body
65 Connector
66 Fastening piece
HP Virtual horizontal plane
Xc Rotational axis (of crankshaft)

MODES FOR CARRYING OUT THE INVENTION

One embodiment of the present invention is explained below by reference to the attached drawings. Here, the top and bottom, front and rear, and left and right of a vehicle body are defined based on the point of view of a person riding a two-wheeled motor vehicle.

First Embodiment

FIG. 1 schematically shows the overall arrangement of a two-wheeled motor vehicle related to one embodiment of the present invention. A two-wheeled motor vehicle 11 includes a vehicle body frame 12. A front fork 14 is steerably supported on a head pipe 13 at the front end of the vehicle body frame 12. A front wheel WF is supported by the front fork 14 so that it can rotate around an axle 15. Handlebars 16 are joined to the front fork 14 on the upper side of the head pipe 13. A swing arm 18 is supported on a pivot frame 17 on the rear side of the vehicle body frame 12 so that it can swing around a support shaft 19 extending horizontally in the vehicle width direction. A rear wheel WR is supported at the rear end of the swing arm 18 so that it can rotate around an axle 21.

An internal combustion engine 23 is mounted on the vehicle body frame 12 between the front wheel WF and the rear wheel WR. The internal combustion engine 23 is arranged as a V-type four cylinder internal combustion engine. The internal combustion engine 23 generates power around a rotational axis Xc. The power of the internal combustion engine 23 is transmitted to the rear wheel WR via a power transmission device (not illustrated).

An exhaust pipe 24 is connected to the internal combustion engine 23. An exhaust muffler 25 is connected to the exhaust pipe 24. The exhaust muffler 25 extends from below the internal combustion engine 23 and has an exhaust port disposed to one side of the axle 21. Exhaust of the internal combustion engine 23 is discharged from the exhaust muffler 25.

A fuel tank 26 is mounted on the vehicle body frame 12 above the internal combustion engine 23. A rider's seat 27 is mounted on the vehicle body frame 12 to the rear of the fuel tank 26. Fuel is supplied from the fuel tank 26 to a fuel injection device of the internal combustion engine 23. When driving the two-wheeled motor vehicle 11 a rider straddles the rider's seat 27.

Figure 2:
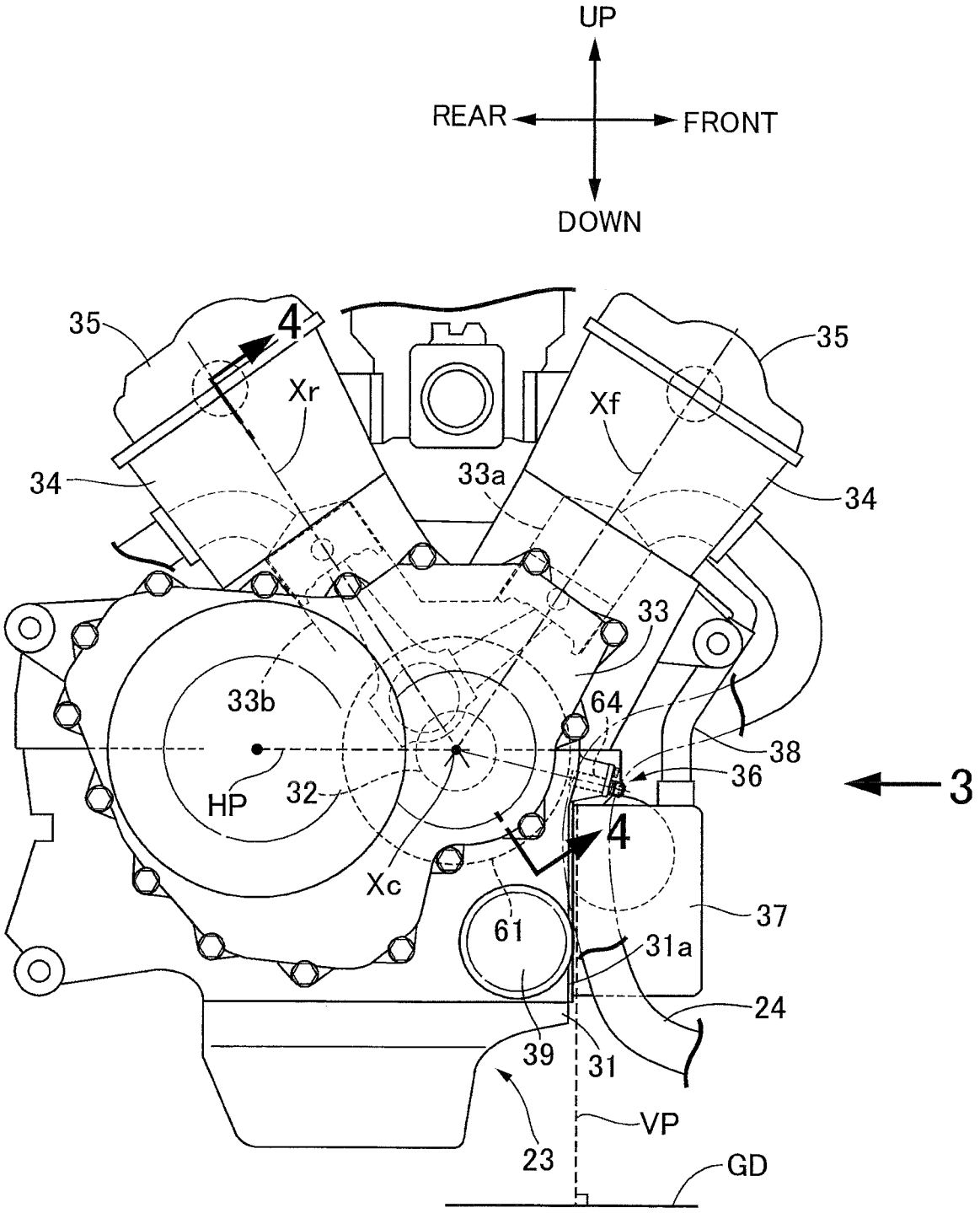
FIG. 2 is an enlarged partial side view of the two-wheeled motor vehicle schematically showing the structure of an internal combustion engine. (first embodiment)

As shown in FIG. 2, the internal combustion engine 23 includes a crankcase 31, a crankshaft 32 supported on the crankcase 31 so that it can rotate around the rotational axis Xc, a cylinder block 33 that is joined to the crankcase 31 and defines front and rear cylinder rows (banks) 33*a* and 33*b*, a cylinder head 34 that is joined to the cylinder block 33 for each of the cylinder rows 33*a* and 33*b*, and a head cover 35 that is joined to the cylinder head 34. The crankcase 31 has a front face 31*a* that receives air flow from the front when the two-wheeled motor vehicle 11 is traveling. The rotational axis Xc of the crankshaft 32 is disposed in parallel with the axle 21 of the rear wheel WR. The front face 31*a* of the crankcase 31 extends along a virtual vertical plane VP that extends in parallel with the rotational axis Xc of the crankshaft 32 and is orthogonal to the ground GD so that the front face 31*a* opposes the front wheel WF from the rear.

The cylinder rows 33*a* and 33*b* are formed as a V-type arrangement in which they are disposed above a virtual horizontal plane HP containing the rotational axis Xc of the crankshaft 32 and intersect each other at a bank angle. The cylinders of the first cylinder row 33*a* on the front side have a cylinder axis Xf that is inclined forward at an angle that is half the bank angle with respect to a virtual vertical plane containing the rotational axis Xc. The cylinders of the second cylinder row 33*b* on the rear side have a cylinder axis Xr that is inclined rearward at an angle that is half the bank angle with respect to a virtual vertical plane containing the rotational axis Xc.

The internal combustion engine 23 includes a pulser sensor (detection sensor) 36 mounted from the outside on the crankcase 31 at a position beneath the virtual horizontal plane HP. The pulser sensor 36 projects from an outer face of the crankcase 31 so as to go away from the rotational axis Xc of the crankshaft 32. The exhaust pipe 24 is disposed on the side, in the vehicle width direction, of the pulser sensor 36 while curving. The exhaust pipe 24 overlaps the pulser sensor 36 when viewed from the side of the vehicle. That is, in a projection of the exhaust pipe 24 and the pulser sensor 36 from a direction orthogonal to a virtual plane 43 that is orthogonal to the rotational axis Xc of the crankshaft 32, the projection image of the exhaust pipe 24 and the projection image of the pulser sensor 36 overlap each other.

An oil cooler 37 is mounted on the front face 31*a* of the crankcase 31 beneath the pulser sensor 36. The oil cooler 37 includes an infeed path joined to an oil passage opening on the front face 31*a* of the crankcase 31 and an outlet path joined to the cylinder head 34 by means of a pipe member 38. Oil that is cooled by the oil cooler 37 is supplied to the cylinder head 34.

An oil filter 39 is mounted on a side face of the crankcase 31 beneath the pulser sensor 36. The oil filter 39 is connected to two oil passages opening on the side face of the crankcase 31. Oil that is discharged from an oil pump is filtered by the oil filter 39 and returned to an oil passage within the crankcase 31.

Figure 3:
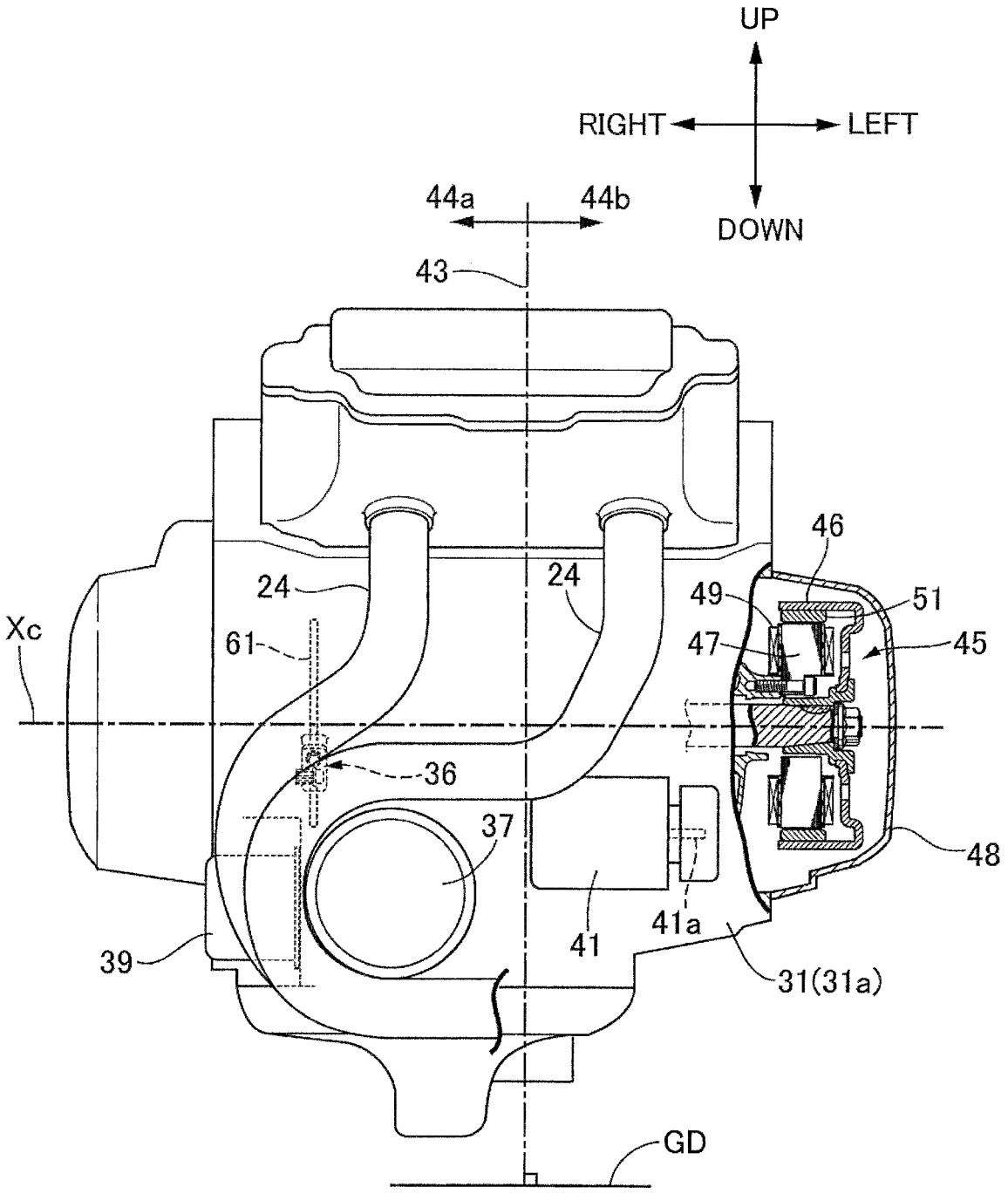
FIG. 3 is an enlarged front view schematically showing the structure of the internal combustion engine. (first embodiment)

As shown in FIG. 3, a starter motor 41 is disposed in front of the front face 31*a* of the crankcase 31. The starter motor 41 has a drive shaft 41*a* that rotates in response to power being supplied. The drive shaft 41*a* has an axis that is parallel to the rotational axis Xc of the crankshaft 32. The drive shaft 41*a* of the starter motor 41 is linked for example to a transmission connected to the crankshaft 32 via a gear mechanism. The starter motor 41 aids rotation of the crankshaft 32 when the internal combustion engine 23 is started. The pulser sensor 36 is disposed in one space 44*a* resulting from partitioning, at a middle position in the axial direction of the crankshaft 32, by the virtual plane 43 orthogonal to the rotational axis Xc of the crankshaft 32, and the starter motor 41 is disposed in another space 44*b* resulting from the partitioning.

The internal combustion engine 23 includes an AC generator (ACG) 45. The AC generator 45 includes an outer rotor 46 fixed to the crankshaft 32 extending through the crankcase 31 and projecting from the crankcase 31, and an inner stator 47 disposed around the crankshaft 32 while being surrounded by the outer rotor 46. A generator cover 48 is joined to the crankcase 31. The generator cover 48 covers the AC generator 45 from the outside.

An electromagnetic coil 49 is wound around the inner stator 47. A magnet 51 is fixed to the outer rotor 46. When the outer rotor 46 rotates relative to the inner stator 47, power is generated in the electromagnetic coil 49.

The exhaust pipe 24 is positioned in front of the front face 31*a* of the crankcase 31, and at least partially overlaps the pulser sensor 36 when viewed from the front. That is, in a projection of the exhaust pipe 24 and the pulser sensor 36 from a direction orthogonal to a vertical virtual plane containing the rotational axis Xc of the crankshaft 32, the projection image of the exhaust pipe 24 and the projection image of the pulser sensor 36 overlap each other. The exhaust pipe 24 curves while bypassing the oil cooler 37 when viewed from the front. That is, in a projection of the exhaust pipe 24 and the oil cooler 37 from a direction orthogonal to the vertical virtual plane containing the rotational axis Xc of the crankshaft 32, the projection image of the exhaust pipe 24 and the projection image of the oil cooler 37 do not overlap each other.

Figure 4:
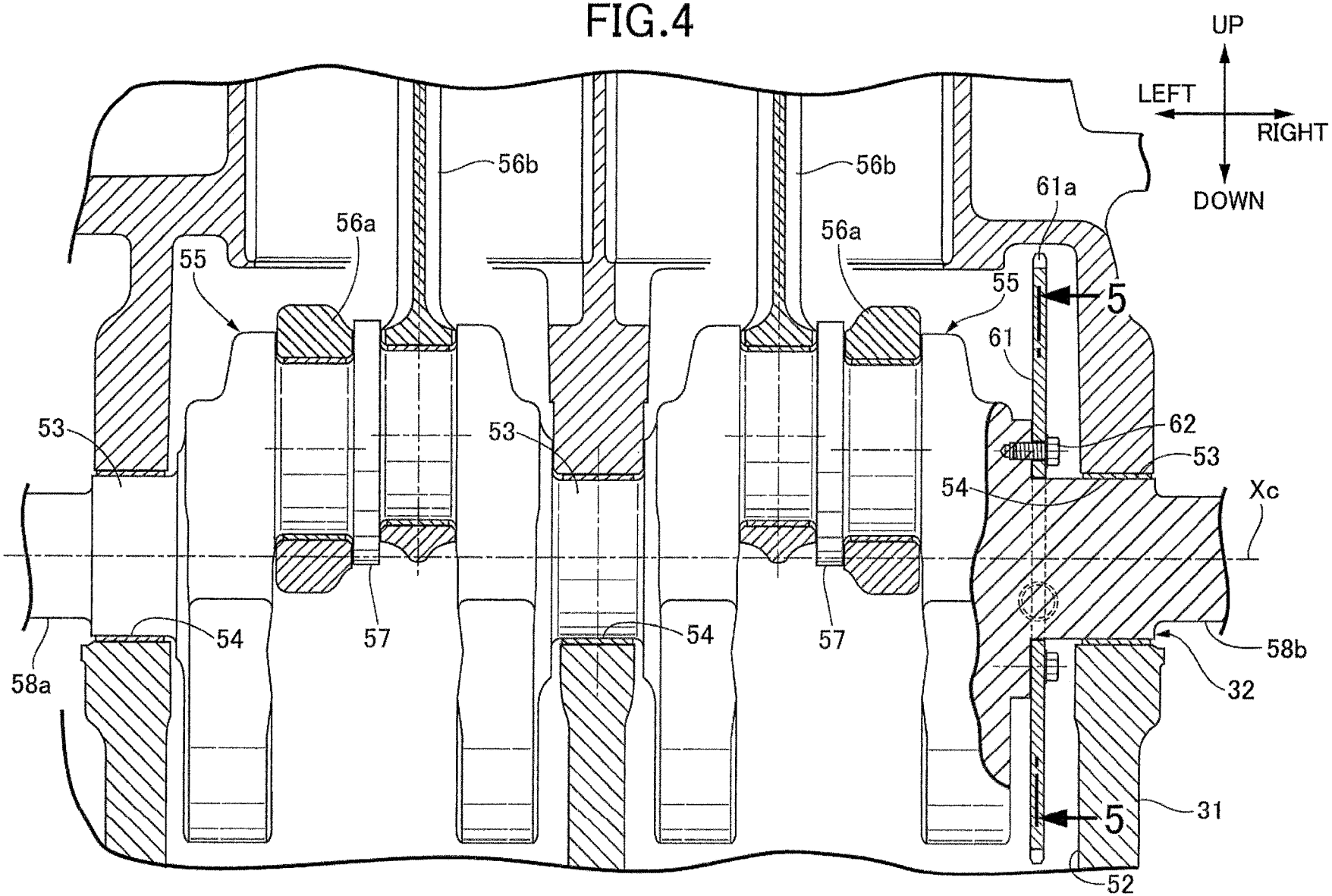
FIG. 4 is an enlarged sectional view of a crankcase along line 4-4 in FIG. 2. (first embodiment)

As shown in FIG. 4, a crank chamber 52 is defined in the crankcase 31. The crankshaft 32 is rotatably supported on a bearing 54 by a journal 53 having an axis that coincides with the rotational axis Xc. The crankshaft 32 has a crank 55 between the journals 53. The crank 55 is housed in the crank chamber 52. An oil passage is connected to the bearing 54, oil filtered by the oil filter 39 being supplied to the oil passage. The middle position in the axial direction of the crankshaft 32 is set based on the journal 53 in the middle.

The crank 55 includes two crank pins 57 linked to connecting rods 56*a* and 56*b*. The crank pin 57 is disposed so as to be parallel to the rotational axis Xc and be displaced from the rotational axis Xc. Linked to the respective crank pin 57 are one piston of the first cylinder row 33*a* on the front side and one piston of the second cylinder row 33*b* on the rear side. Here, cylinders of the second cylinder row 33*b* are disposed so as to be as close to each other as possible, and cylinders of the first cylinder row 33*a* are disposed with a gap therebetween. Therefore, the connecting rods 56*b* of the second cylinder row 33*b* are linked to the crank pins 57 on the side where the bearing 54 in the middle is, and the connecting rods 56*a* of the first cylinder row 33*a* are linked to the crank pins 57 on the side where the bearings 54 on the outside in the axial direction are. Linear movement in the axial direction of the piston is converted into rotation of the crankshaft 32 of by virtue of the action of the connecting rods 56*a* and 56*b*. The virtual plane 43, which is orthogonal to the rotational axis Xc of the crankshaft 32 at the middle position in the axial direction of the crankshaft 32, forms a lateral plane of symmetry for the cylinders.

The crankshaft 32 includes a first drive shaft 58*a* projecting from the crankcase 31 via one end in the axial direction, and a second drive shaft 58*b* projecting from the crankcase 31 via the other end in the axial direction. As described above, the outer rotor 46 of the AC generator 45 is fixed to the first drive shaft 58*a*. Fixed to the second drive shaft 58*b* is a sprocket for a cam chain (not illustrated) or a drive gear (not illustrated) meshing with an input gear of a transmission.

Figure 5:
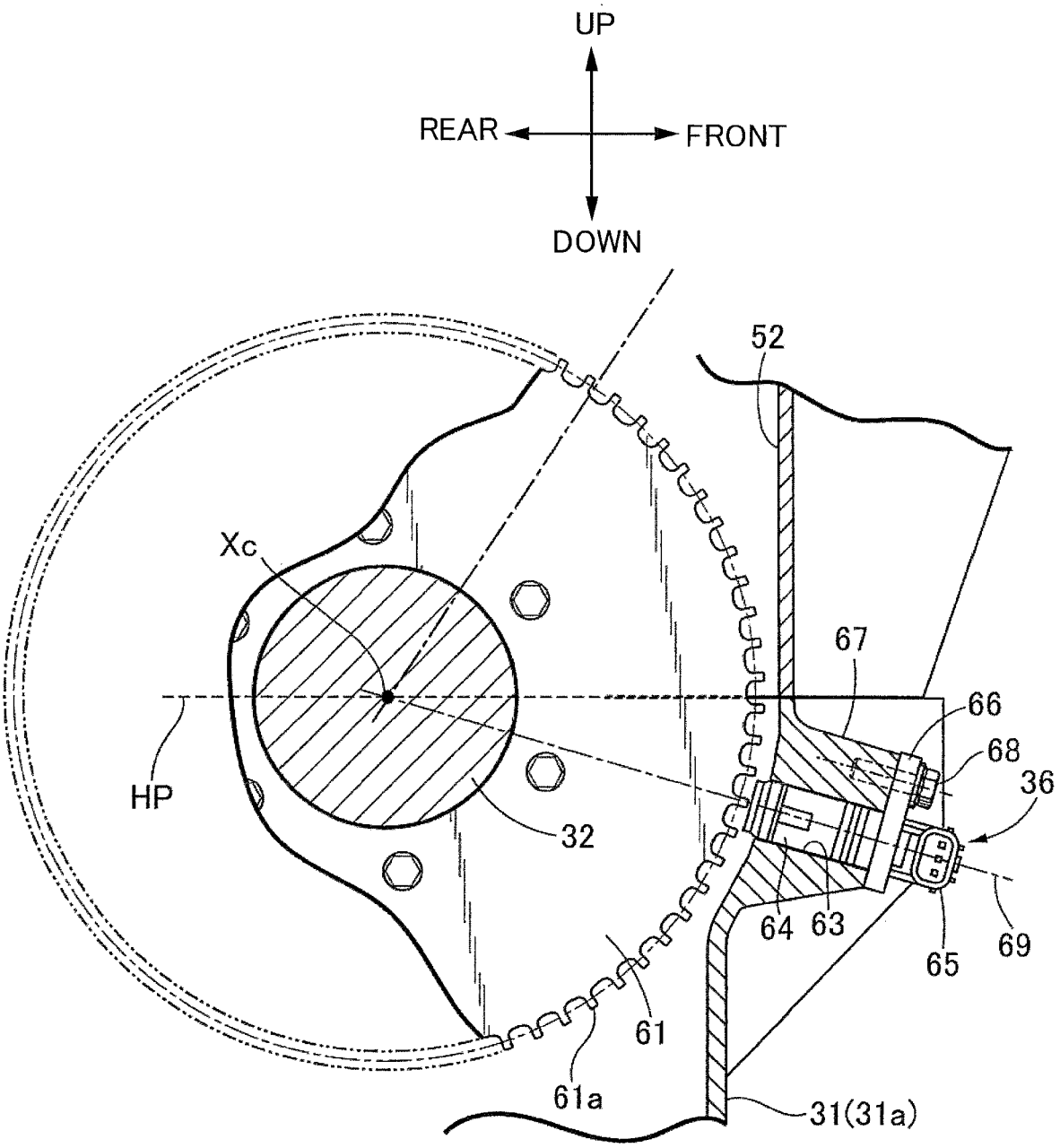
FIG. 5 is an enlarged sectional view of the crankcase along line 5-5 in FIG. 4. (first embodiment)

Referring in addition to FIG. 5, a pulser ring (to-be-detected body) 61 is mounted on the journal 53 that is continuous with the second drive shaft 58*b*, within the crank chamber 52. The pulser ring 61 is coaxial with the rotational axis Xc and is formed into an annular plate shape that rotates integrally with the crankshaft 32. The pulser ring 61 is for example superimposed on one face of a crank web forming the crank 55 and is fixed thereto. For example a screw 62 is used for fixing. Due to the screw 62 being mounted from the outside in the axial direction of the pulser ring 61, a dead space within the crankcase 31 can be exploited effectively.

The pulser ring 61 includes a plurality of reluctors (gear teeth) 61*a* arranged at equal intervals in an annular shape around the rotational axis Xc. The reluctors 61*a* are disposed with a central angle of for example 10 degrees therebetween. The reluctor 61*a* is formed from for example a magnetic body. The pulser sensor 36 is made to face the annular trajectory of the pulser ring 61 and generates a pulse signal in response to movement of the pulser ring 61.

As shown in FIG. 5, the pulser sensor 36 includes a main body 64 that is inserted into a through hole 63 formed in the crankcase 31 and faces the crank chamber 52 via a detection part at the extremity, a connector 65 that is joined to the main body 64 and disposed in a space outside the crankcase 31, and a fastening piece 66 that is joined to the main body 64 and fastened to the front face 31*a* of the crankcase 31. The pulser sensor 36 outputs an electric signal in response to the magnetic body, which is detected on the trajectory of the pulser ring 61, being present. The pulser sensor 36 outputs a pulse signal that identifies the angular position of the crankshaft 32. Alternatively, an eddy current type microdisplacement sensor may be used as the pulser sensor 36.

The fastening piece 66 is superimposed on an upper face of a pedestal 67 projecting from the front face 31*a* of the crankcase 31 and fastened to the pedestal 67 by means of a bolt 68. In the pulser sensor 36 a detection axis 69 that has the highest sensitivity is directed at the rotational axis Xc of the crankshaft 32.

The operation of this embodiment is now explained. In the present embodiment the pulser sensor 36 is mounted from the outside at a position, beneath the virtual horizontal plane HP containing the rotational axis Xc, on the front face 31*a* of the crankcase 31. Due to the pulser sensor 36 being mounted on the crankcase 31 the pulser ring 61 is separated from the outer rotor 46 of the AC generator 45. In this way the influence of an electromagnetic force acting between the outer rotor 46 and the inner stator 47 is avoided. The angular velocity of the crankshaft 32 is detected with high precision. Moreover, the pulser sensor 36 is protected beneath the forwardly inclined cylinder block 33. The pulser sensor 36 receives air flow and is thus cooled. In addition, since the pulser sensor 36 is mounted from the outside of the crankcase 31, any increase in the dimensions of the crankcase 31 can be avoided. On the other hand, if the pulser sensor 36 were to be disposed on the inside of the crankcase 31 or a case cover, it would not be possible to avoid an increase in the dimensions of the crankcase 31 or the case cover. An increase in the dimensions of the crankcase 31 or the case cover would cause a local increase in the weight of the internal combustion engine 23, thus degrading the weight balance of the internal combustion engine 23.

The internal combustion engine 23 related to the present embodiment includes the oil cooler 37 mounted on the outer face of the crankcase 31 beneath the pulser sensor 36. The oil cooler 37 protects the pulser sensor 36 from stones, etc. scattered up from the ground GD. In addition, the internal combustion engine 23 includes the oil filter 39 mounted on the outer face of the crankcase 31 at a position lower than the pulser sensor 36. The oil filter 39 protects the pulser sensor 36 from stones, etc. scattered up from the ground GD. Moreover, the internal combustion engine 23 includes the exhaust pipe 24, which is positioned further forward than the front face 31*a* of the crankcase 31 and at least partially overlaps the pulser sensor 36 when viewed from the front. The exhaust pipe 24 protects the pulser sensor 36 from stones, etc. coming from the front.

In the present embodiment, as described above, when the virtual plane 43, which is orthogonal to the rotational axis Xc of the crankshaft 32 at the middle position in the axial direction of the crankshaft 32, is set, the pulser sensor 36 is disposed in one space 44*a* resulting from partitioning by the virtual plane 43, and the starter motor 41 and the AC generator 45 are disposed in the other space 44*b*. Since the pulser sensor 36 is thus distant from the starter motor 41 and the AC generator 45, the influence of the magnetic force of the starter motor 41 or the AC generator 45 is avoided.

The pulser sensor 36 is inserted into the through hole 63 formed in the crankcase 31 and faces the crank chamber 52 via the detection part at the extremity. Since the pulser sensor 36 is merely inserted into the through hole 63 of the crankcase 31, the pulser sensor 36 can easily be fitted into the internal combustion engine 23.

The invention claimed is:

1. An internal combustion engine comprising:

a crankcase that defines a crank chamber;

a crankshaft that is rotatably supported on the crankcase;

a cylinder block that is joined to the crankcase and defines a plurality of cylinders in a V-type arrangement in which the cylinders are disposed above a virtual horizontal plane including a rotational axis of the crankshaft and intersect each other at a bank angle;

a to-be-detected body that rotates integrally with the crankshaft;

a detection sensor that is mounted from an outside at a position, lower than the virtual horizontal plane, of a front face of the crankcase that receives air flow, is made to face a trajectory of the to-be-detected body, and generates a pulse signal in response to movement of the to-be-detected body;

an oil cooler mounted on an outer face of the crankcase beneath the detection sensor; and an exhaust pipe that has a curved portion formed to curve while bypassing the oil cooler, the curved portion of the exhaust pipe at least partially overlapping the detection sensor when viewed from a front of the engine.

2. The internal combustion engine according to claim 1, wherein the detection sensor is disposed in one space resulting from partitioning by a virtual plane that is orthogonal to the rotational axis of the crankshaft at a middle position in an axial direction of the crankshaft, and a starter motor is disposed in another space resulting from the partitioning.

3. The internal combustion engine according to claim 1, further comprising an oil filter mounted on the outer face of the crankcase at a position beneath the detection sensor.

4. The internal combustion engine according to claim 1, wherein the detection sensor is disposed in one space resulting from partitioning by a virtual plane that is orthogonal to the rotational axis of the crankshaft at the middle position in the axial direction of the crankshaft, and an AC generator is disposed in another space.

5. The internal combustion engine according to claim 1, wherein the detection sensor comprises:

a main body that is inserted into a through hole formed in the crankcase and faces the crank chamber via a detection part at an extremity;

a connector that is joined to the main body and is disposed in a space outside the crankcase; and a fastening piece that is joined to the main body and is fastened to an outer face of the crankcase.

6. An internal combustion engine comprising:

a crankcase that defines a crank chamber;

a crankshaft that is rotatably supported on the crankcase;

a cylinder block that is joined to the crankcase and defines a plurality of cylinders in which the cylinders are disposed above a virtual horizontal plane including a rotational axis of the crankshaft;

a to-be-detected body that rotates integrally with the crankshaft; and a sensor that is mounted to the crankcase and faces a trajectory of the to-be-detected body, and generates a pulse signal in response to movement of the to-be-detected body, wherein the sensor comprises:

a main body that is inserted into a through hole formed in the crankcase and faces the crank chamber via a detection part at an extremity;

a connector that is joined to the main body and is disposed in a space outside the crankcase; and a fastening piece that is joined to the main body and is fastened to an outer face of the crankcase.

7. An internal combustion engine comprising:

a crankcase that defines a crank chamber;

a crankshaft extending in a horizontal direction and rotatably supported on the crankcase;

a cylinder block that is joined to the crankcase in which the cylinders are disposed above a virtual horizontal plane including through a rotational axis of the crankshaft;

a body that rotates integrally with the crankshaft; and a sensor extending outwardly from the crankcase, the sensor facing a trajectory of the body, and generating a pulse signal in response to movement of the body.

8. The internal combustion engine of claim 7, wherein the crankshaft extends between a right side and a left side of the crankcase.

9. The internal combustion engine of claim 7, further comprising an oil cooler at a front wall of the crankcase, the oil cooler being below the sensor.

10. The internal combustion engine of claim 7, wherein the sensor extends outwardly from a front wall of the crankcase.

11. The internal combustion engine of claim 7, further comprising an exhaust pipe at a front wall of the crankcase, the sensor being between the crankcase and exhaust pipe when viewed in a horizontal direction from a front of the engine.

12. The internal combustion engine of claim 11, wherein the exhaust pipe extends in a vertical direction.

* * * * *